US010851701B2

(12) United States Patent
Kawamoto et al.

(10) Patent No.: US 10,851,701 B2
(45) Date of Patent: Dec. 1, 2020

(54) ENGINE COOLING SYSTEM

(71) Applicant: TOYOTA JIDOSHA KABUSHIKI KAISHA, Toyota (JP)

(72) Inventors: Naoya Kawamoto, Nissin (JP); Rihito Kaneko, Miyoshi (JP); Hirokazu Ando, Seto (JP); Yusuke Niwa, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 130 days.

(21) Appl. No.: 15/888,427

(22) Filed: Feb. 5, 2018

(65) Prior Publication Data

US 2018/0266305 A1 Sep. 20, 2018

(30) Foreign Application Priority Data

Mar. 16, 2017 (JP) ..... 2017-051523

(51) Int. Cl.

| | |
|---|---|
| ***F01P 7/16*** | (2006.01) |
| ***F01P 3/20*** | (2006.01) |
| *F01P 5/10* | (2006.01) |
| *F01P 7/14* | (2006.01) |

(52) U.S. Cl.

CPC ..... *F01P 7/16* (2013.01); *F01P 7/167* (2013.01); *F01P 3/20* (2013.01); *F01P 5/10* (2013.01); *F01P 2007/146* (2013.01); *F01P 2025/13* (2013.01); *F01P 2025/52* (2013.01); *F01P 2025/64* (2013.01)

(58) Field of Classification Search

CPC ..... F01P 7/16; F01P 7/167; F01P 3/20; F01P 5/10; F01P 2007/146

USPC ..... 123/41.08

See application file for complete search history.

(56) References Cited

U.S. PATENT DOCUMENTS

| | | | | |
|---|---|---|---|---|
| 6,539,899 | B1 * | 4/2003 | Piccirilli | F01P 7/167 123/41.08 |
| 7,168,397 | B2 * | 1/2007 | Chanfreau | B60H 1/00485 123/41.01 |
| 7,302,919 | B2 * | 12/2007 | Vacca | B60H 1/00485 123/41.08 |
| 8,978,599 | B2 * | 3/2015 | Shioura | F01P 7/165 123/41.44 |

FOREIGN PATENT DOCUMENTS

| | | |
|---|---|---|
| JP | 2013-234605 A | 11/2013 |

* cited by examiner

*Primary Examiner* — Syed O Hasan
(74) *Attorney, Agent, or Firm* — Oliff PLC

(57) ABSTRACT

An engine cooling system includes a coolant circulation path, which circulates coolant between the water jacket and the radiator of an internal combustion engine, a pump, a control valve, which is provided in the coolant circulation path, and a controller. The controller executes a warming-up promotion control and a pressure relaxation control. In the pressure relaxation control, the controller controls the aperture ratio of the radiator port such that the lower the temperature of the radiator, the lower becomes the engine rotational speed at which the aperture ratio of the radiator port is increased.

8 Claims, 5 Drawing Sheets

ENGINE COOLING SYSTEM

BACKGROUND

The present disclosure relates to an engine cooling system that circulates coolant by a pump that operates in conjunction with rotation of the output shaft of an internal combustion engine.

Japanese Laid-Open Patent Publication No. 2013-234605 discloses an engine cooling system in which a control valve provided in a coolant circulation path is closed to stop circulation of coolant to a radiator and promote warming-up. In the case of the engine cooling system in which the coolant is circulated by a pump that operates in conjunction with the rotation of the output shaft of the internal combustion engine, when the engine rotational speed increases, the amount of the coolant discharged from the pump per unit time increases. Therefore, if the circulation of the coolant to the radiator is stopped, the pressure in the coolant circulation path rises, and there is a risk of a large load being applied to components such as pipes constituting the coolant circulation path. Therefore, in the engine cooling system described in the above Patent Document, even if the warming-up is not completed, when the engine rotational speed becomes equal to or higher than a predetermined engine rotational speed, the control valve is opened. Therefore, the coolant is circulated to the radiator.

When the control valve is opened on the basis of the engine rotational speed equal to or higher than the predetermined engine rotational speed, the coolant warmed through the internal combustion engine flows into the radiator, in which circulation of the coolant has been stopped. As a result, there is a possibility that the radiator will be rapidly warmed up and large thermal distortion occurs in the radiator.

SUMMARY

In accordance with one aspect, an engine cooling system is provided that includes a coolant circulation path, which circulates coolant between a water jacket and a radiator of an internal combustion engine, a pump, which is provided in the coolant circulation path and operates in conjunction with rotation of an output shaft of the internal combustion engine, a control valve, and a controller. The control valve is provided in the coolant circulation path and has a housing having a radiator port connected to the radiator and a valve body accommodated in the housing. The control valve is configured such that an aperture ratio of the radiator port changes in a range from 0% to 100% by movement of the valve body inside the housing. The controller is configured to control the control valve. The controller is configured to execute: a warming-up promotion control for setting the aperture ratio of the radiator port to 0% when warming-up of the internal combustion engine is not completed; and a pressure relaxation control for increasing the aperture ratio of the radiator port when the engine rotational speed is equal to or higher than a predetermined engine rotational speed even if warming-up of the internal combustion engine is not completed, as compared with a case where the engine rotational speed is less than the predetermined engine rotational speed. The controller is configured to control the aperture ratio of the radiator port in the pressure relaxation control such that, as compared with a case in which the temperature of the radiator is high, the lower the temperature of the radiator, the lower becomes the engine rotational speed at which the aperture ratio of the radiator port is increased.

When the stop of the circulation of the coolant to the radiator using the warming-up promotion control is canceled, the coolant warmed through the internal combustion engine flows into the radiator. In that case, since the temperature change of the radiator becomes larger as the temperature of the radiator is lowered, the thermal distortion of the radiator is liable to increase. In this regard, according to the aforementioned configuration, when the temperature of the radiator is low, the aperture ratio of the radiator port increases at a lower engine rotational speed, and the stop of circulation by the warming-up promotion control is canceled.

The discharge amount of the coolant per unit time from the pump, which operates in conjunction with the rotation of the output shaft of the internal combustion engine, is decreased as the engine rotational speed is lowered. Therefore, according to the above configuration, when the temperature of the radiator is low, the stop of the circulation of the coolant to the radiator is canceled in a state in which the engine rotational speed is lower, that is, in a state in which the discharge amount from the pump is small. This makes it possible to alleviate the temperature change of the radiator when the stop of the circulation of the coolant to the radiator is canceled as compared with a case where the stop of the circulation is canceled in a state in which the discharge amount from the pump is large, and it is possible to suppress the thermal distortion of the radiator due to cancellation of the stop of circulation.

Therefore, according to the above configuration, it is possible to suppress the effect of a large load on components such as the pipes constituting the coolant circulation path, while suppressing the thermal distortion of the radiator caused by the cancellation of the stop of the circulation of the coolant to the radiator.

In accordance with one aspect of the engine cooling system, the controller is configured to control the aperture ratio of the radiator port in the pressure relaxation control such that the lower the temperature of the radiator, the lower becomes the engine rotational speed at which the aperture ratio of the radiator port is increased.

In order to promote warming-up, it is preferable to stop the circulation of the coolant to the radiator as much as possible until the warming-up is completed.

In this regard, according to the aforementioned configuration, as the temperature of the radiator is low and large thermal distortion is more likely to occur with the cancellation of the stop of circulation of the coolant to the radiator, the aperture ratio of the radiator port is increased in the state in which the discharge amount from the pump is small, and the stop of the circulation of the coolant to the radiator is canceled. That is, the engine rotational speed for cancelling the stop of circulation changes in accordance with the magnitude of the risk of occurrence of thermal distortion. Therefore, it is possible to promote warming-up and protect the engine cooling system at the same time.

If the period during which the operation of the internal combustion engine is stopped until the start of the internal combustion engine is sufficiently long, the temperature of the radiator becomes equal to the outdoor air temperature. Therefore, in the pressure relaxation control executed between the start of the internal combustion engine and the completion of the warming-up, the temperature of the radiator can be estimated using the outdoor air temperature.

Accordingly, in accordance with one aspect of the engine cooling system, the controller may be configured to execute the pressure relaxation control by regarding an outdoor air temperature as the temperature of the radiator.

Also, in accordance with one aspect of the engine cooling system, controller is configured to control the control valve in accordance with the engine rotational speed such that the higher the engine rotational speed, the higher the aperture ratio of the radiator port becomes, when the aperture ratio of the radiator port is increased in the pressure relaxation control.

According to the aforementioned configuration, as the engine rotational speed is high and the amount of coolant discharged from the pump per unit time is increased, that is, as the pressure in the coolant circulation path is more likely to rise, the aperture ratio of the radiator port increases. As a result, the aperture ratio of the radiator port can be increased in accordance with the magnitude of the risk that the pressure in the coolant circulation path may rise. Therefore, according to the aforementioned configuration, it is possible to further promote warming-up and protect the engine cooling system.

In accordance with one aspect of the engine cooling system, the controller is configured to execute the pressure relaxation control on condition that the aperture ratio of the radiator port is equal to or less than a reference aperture ratio lower than 100%.

In the first place, when the aperture ratio of the radiator port is sufficiently large, there may be a case where it is not necessary to execute the pressure relaxation control to increase the aperture ratio of the radiator port. In this regard, according to the aforementioned configuration, since the pressure relaxation control is executed on condition that the aperture ratio of the radiator port is equal to or less than the reference aperture ratio, it is possible to suppress the execution of the pressure relaxation control in a case where the aperture ratio of the radiator port increases and the restriction of circulation of the coolant to the radiator does not need to be alleviated.

In accordance with one aspect of the engine cooling system, the controller is configured to execute the pressure relaxation control on condition that the engine rotational speed is equal to or higher than a reference rotational speed.

When the engine rotational speed is low, since the discharge amount of the coolant from the pump per unit time is small, it is not necessary to execute the pressure relaxation control to increase the aperture ratio of the radiator port in some cases. In this regard, according to the aforementioned configuration, since the pressure relaxation control is executed on condition that the engine rotational speed is equal to or higher than the reference rotational speed, when it is not necessary to increase the aperture ratio of the radiator port to alleviate the restriction of the circulation of the coolant to the radiator, it is possible to suppress the execution of the pressure relaxation control.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

An engine cooling system according to one embodiment will now be described with reference to FIGS. 1 to 7. The engine cooling system cools an internal combustion engine by circulating coolant in the water jacket of the internal combustion engine.

Figure 1:
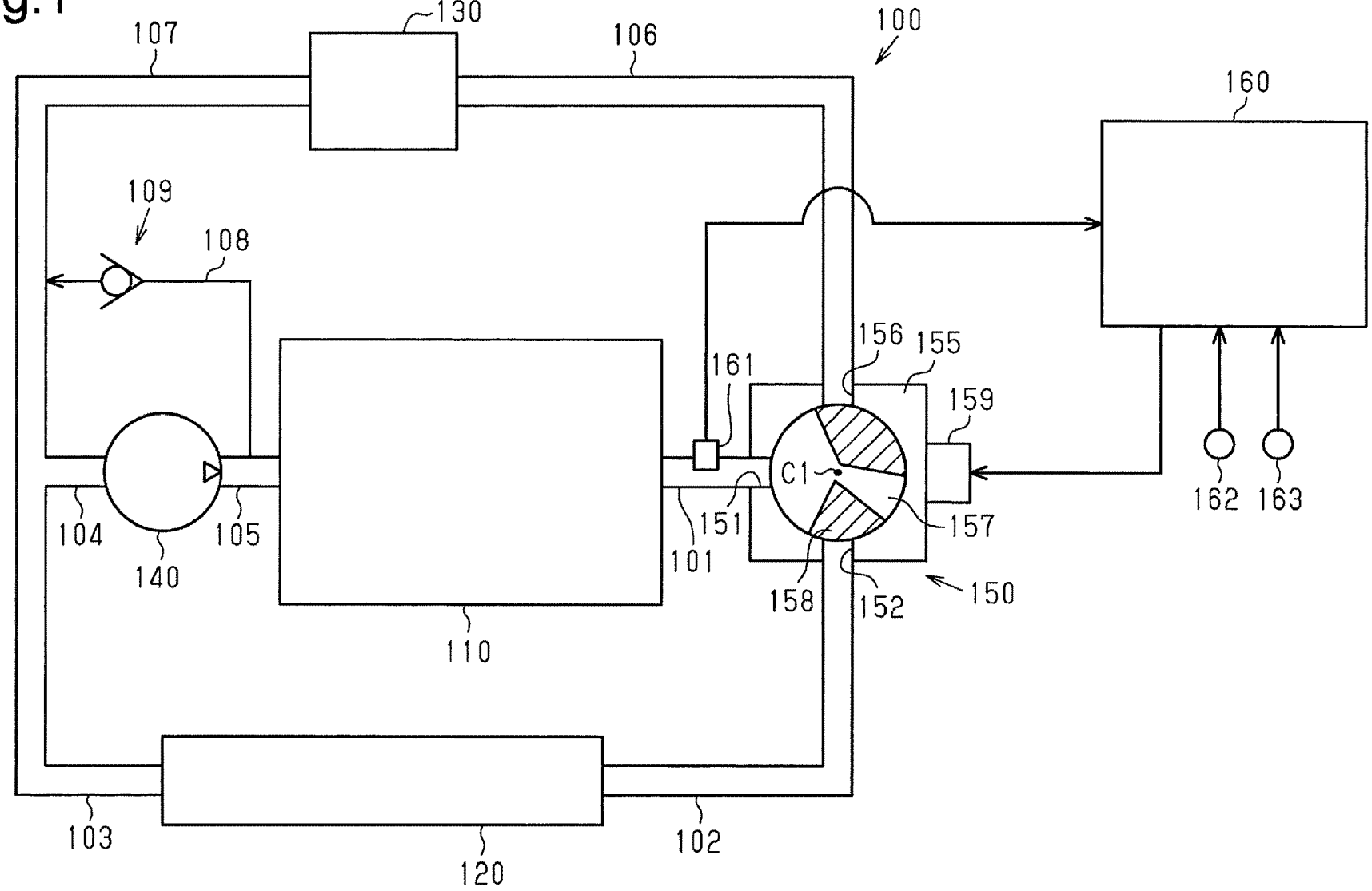
FIG. 1 is a schematic diagram illustrating a configuration of an engine cooling system according to one embodiment.

As illustrated in FIG. 1, the engine cooling system includes a coolant circulation path 100, which circulates coolant between a water jacket 110 and a radiator 120 of the internal combustion engine. The coolant circulation path 100 branches at a halfway position and includes a path for circulating coolant to a device 130 without passing through the radiator 120. Further, the device 130 is a device other than the radiator 120, which uses the coolant as a medium of heat, and is, for example, a throttle body or an EGR valve, and an oil cooler, which cools the lubricating oil of the internal combustion engine.

In the middle of the coolant circulation path 100, there is provided a pump 140, which operates in conjunction with the rotation of the crankshaft, which is the output shaft of the internal combustion engine. A pump outlet passage 105 connected to the inlet of the water jacket 110 is connected to the outlet of the pump 140. As a result, the coolant discharged from the pump 140 is introduced into the water jacket 110 through the pump outlet passage 105. The pump 140 operates in conjunction with the rotation of the crankshaft. Therefore, the discharge amount of the coolant per unit time from the pump 140 increases as the engine rotational speed NE, which is the rotational speed of the crankshaft, increases.

A water jacket outlet passage 101 connected to the control valve 150 is connected to the outlet of the water jacket 110. The control valve 150 includes a housing 155 having an inlet port 151, a radiator port 152, and a device port 156. The control valve 150 accommodates a valve body 158 for switching communication and shut-off of the respective ports 151, 152, and 156 inside the housing 155. The valve body 158 has a valve body inner passage 157. By turning the valve body 158 around a rotation axis C1 in the housing 155, the communication and shut-off of the respective ports 151, 152, and 156 are switched. Since the valve body 158 is driven by a motor 159, the direction of the valve body 158 can be controlled by controlling the motor 159. The water jacket outlet passage 101 is connected to the inlet port 151 of the control valve 150.

A radiator inlet pipe 102 connected to the inlet of the radiator 120 is connected to the radiator port 152 of the control valve 150. A radiator outlet pipe 103 is connected to an outlet of the radiator 120. The radiator outlet pipe 103 is connected to a pump inlet passage 104 connected to the inlet of the pump 140. Therefore, when the inlet port 151 communicates with the radiator port 152 via the valve body inner passage 157, the coolant having passed through the water jacket 110 is introduced into the radiator 120 via the control valve 150. The coolant having passed through the radiator 120 is drawn into the pump 140 through the radiator outlet pipe 103 and the pump inlet passage 104. As a result, the coolant is circulated between the water jacket 110 and the radiator 120.

A device inlet pipe 106 connected to the inlet of the device 130 is connected to the device port 156 of the control valve 150. A device outlet pipe 107 connected to the pump inlet passage 104 is connected to the outlet of the device 130. Therefore, when the inlet port 151 communicates with the device port 156 via the valve body inner passage 157, the coolant having passed through the water jacket 110 is introduced into the device 130 via the control valve 150. The coolant having passed through the device 130 is drawn into the pump 140 through the device outlet pipe 107 and the pump inlet passage 104. As a result, the coolant circulates between the water jacket 110 and the device 130. That is, in the engine cooling system, the device inlet pipe 106 and the device outlet pipe 107 constitute a path in which the coolant is allowed to circulate to the device 130 without passing through the radiator 120.

Further, as illustrated in FIG. 1, the pump outlet passage 105 and the device outlet pipe 107 are connected by a relief passage 108. In the middle of the relief passage 108, a relief valve 109 is provided to allow the flow of the coolant from the pump outlet passage 105 to the device outlet pipe 107 when the pressure in the pump outlet passage 105 is higher than the pressure in the device outlet pipe 107.

The control valve 150 is controlled by the controller 160. An air flowmeter 162 is connected to the controller 160. The air flowmeter 162 detects the intake air amount GA, which is the flow rate of the air flowing through the intake passage of the internal combustion engine and the temperature of the air, that is, the outdoor air temperature Tha. A crank position sensor 163, which detects a crank angle which is a rotation phase of the crankshaft, is also connected to the controller 160. The controller 160 calculates the engine rotational speed NE on the basis of a crank angle detected by the crank position sensor 163.

Further, in the water jacket outlet passage 101, there is provided an outlet liquid temperature sensor 161, which detects an outlet liquid temperature Thwout which is the temperature of the coolant discharged from the outlet of the water jacket 110. The outlet liquid temperature sensor 161 is also connected to the controller 160. The controller 160 is configured to control the control valve 150 on the basis of the outlet liquid temperature Thwout, the outdoor air temperature Tha, and the engine rotational speed NE.

Figure 2:
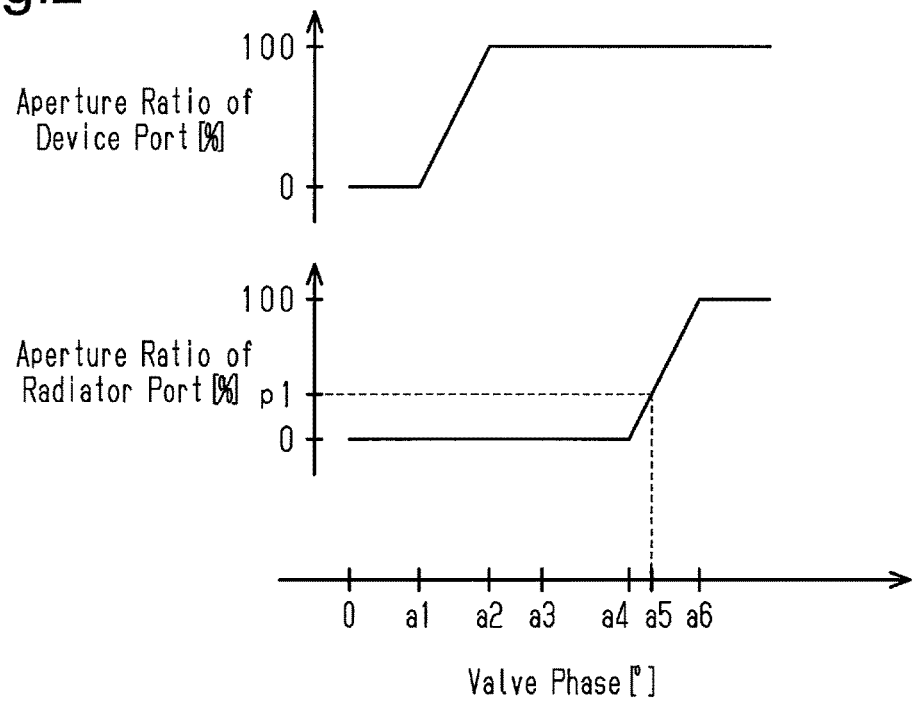
FIG. 2 is a graph illustrating a relationship between a valve phase of a valve body in a control valve and an aperture ratio of each port.

As illustrated in FIG. 2, the valve body inner passage 157 is configured in the control valve 150 such that the aperture ratio of the device port 156 and the aperture ratio of the radiator port 152 change in accordance with the change in valve phase of the valve body 158. Regarding the valve phase, the position illustrated in FIG. 1 is defined as the position where the valve phase is 0[° ]. The valve phase is indicated by the angle of rotation of the valve body 158 in the clockwise direction in FIG. 1 from this position. The aperture ratio is the ratio of the opening area to the opening area at the time of fully opening each of the ports 152 and 156. The aperture ratio 100[%] indicates a fully opened state, and 0[%] indicates a fully closed state.

As illustrated in FIG. 2, in the control valve 150, the aperture ratios of both the device port 156 and the radiator port 152 are maintained at 0[%] while the valve phase is from 0[° ] to a1[° ]. When the valve phase becomes larger than a1[° ], the device port 156 starts to open, and as the valve phase increases, the aperture ratio of the device port 156 increases. When the valve phase becomes a2[° ], the aperture ratio of the device port 156 becomes 100[%]. Further, the aperture ratio of the radiator port 152 is maintained at 0[%] even when the valve phase is from a1[° ] to a2[° ].

Further, while the valve phase is from a2[° ] to a4[° ], the aperture ratio of the device port 156 is maintained at 100[%], and the aperture ratio of the radiator port 152 is maintained at 0[%]. When the valve phase becomes larger than a4[° ], the radiator port 152 starts to open, and as the valve phase increases, the aperture ratio of the radiator port 152 increases. Further, when the valve phase becomes a6[° ], the aperture ratio of the radiator port 152 becomes 100[%]. The aperture ratio of the device port 156 is maintained at 100[%] even when the valve phase is from a2[° ] to a6[° ].

In this way, in the control valve 150 of the engine cooling system, the valve phase changes as the valve body 158 rotates around the rotation axis C1 in the housing 155. Accordingly, the aperture ratios of the ports 152 and 156 change in a range between 0[%] and 100[%]. The controller 160 is configured to control the motor 159 to change the valve phase and control the aperture ratios of each of the ports 152 and 156 in the control valve 150. In order to control the control valve 150, the controller 160 calculates a request valve phase to set a target valve phase, and drives the motor 159 so that the valve phase coincides with the target valve phase. Further, unless the target valve phase is limited by a lower limit valve phase Lgrd to be described later, the target valve phase is basically set to a value equal to the request valve phase.

Specifically, when warming-up of the internal combustion engine is not completed, that is, when the outlet liquid temperature Thwout is lower than the warming-up completion temperature, the controller 160 calculates the request valve phase as follows. The warming-up completion temperature is, for example, 80[° C.].

When the outlet liquid temperature Thwout is lower than the warming-up completion temperature, the controller 160 holds the request valve phase at 0[°] such that the aperture ratios of the respective ports 152 and 156 become 0[%] until a predetermined period elapses after the start of the engine. Thus, by stopping the circulation of the coolant to the radiator 120 and the device 130, the temperature rise of the cylinder wall surface of the internal combustion engine, that is, the warming-up is promoted. In this engine cooling system, the length of the period during which the request valve phase is maintained at 0[° ] is variably set in accordance with the outlet liquid temperature Thwout at the time of start of the engine such that the lower the outlet liquid temperature Thwout at the time of the start of the engine, the longer the period becomes. Further, when all the aperture ratios of the ports 152 and 156 are 0[%], the pressure in the pump outlet passage 105 becomes higher than the pressure in the device outlet pipe 107, with the driving of the pump 140, which operates in conjunction with the rotation of the crankshaft. As a result, the relief valve 109 opens, and the coolant flows through the relief passage 108 from the pump outlet passage 105 to the device outlet pipe 107. That is, at this time, the coolant discharged from the pump 140 circulates through the relief passage 108.

When a predetermined period of time has elapsed from the start of the engine, the controller 160 changes the request valve phase to open the device port 156. Specifically, in order to rotate the valve body 158 in the clockwise direction in FIG. 1, the controller 160 sets the request valve phase to a3[° ], which is larger than a2[° ] and smaller than a4[°]. When the valve phase becomes a3[°], the aperture ratio of the device port 156 becomes 100[%], while the aperture ratio of the radiator port 152 is held at 0[%]. As a result, after the coolant discharged from the pump 140 passes through the water jacket 110, the coolant passes through the device 130, and returns to the pump 140 without being supplied to the radiator 120.

When the warming-up of the internal combustion engine is completed, that is, when the outlet liquid temperature Thwout becomes equal to or higher than the warming-up completion temperature, the controller 160 changes the request valve phase from a4[° ] to a6[° ] in accordance with the difference between the target liquid temperature and the outlet liquid temperature Thwout. That is, when the outlet liquid temperature Thwout is higher than the target liquid temperature, the request valve phase is increased so that the aperture ratio of the radiator port 152 increases, and when the outlet liquid temperature Thwout is lower than the target liquid temperature, the request valve phase is reduced so that the aperture ratio of the radiator port 152 decreases. As a result, the controller 160 changes the aperture ratio of the radiator port 152 so that the outlet liquid temperature Thwout approaches the target liquid temperature by the feedback-control of the request valve phase.

Further, the aforementioned control is a warming-up promotion control. That is, the warming-up promotion control is a control for calculating the request valve phase so that the aperture ratio of the radiator port 152 is 0[%] when the warming-up of the internal combustion engine is not completed, stopping the circulation of the coolant to the radiator 120, and promoting the warming-up.

When the warming-up promotion control is executed to stop the circulation of the coolant to the radiator 120, if the engine rotational speed NE rises and the amount of the coolant discharged from the pump 140 per unit time increases, there is a risk of application of a large load to the components such as pipes constituting the coolant circulation path 100. For example, when both the aperture ratios of the device port 156 and the radiator port 152 are 0[%], the coolant circulates through the relief passage 108, but the amount of coolant that can be circulated through the relief passage 108 is limited. Therefore, when the engine rotational speed NE rises, the pressure in the pump outlet passage 105 and the water jacket outlet passage 101 rises, and there is a risk of application of a large load to the pump outlet passage 105 and the water jacket outlet passage 101. Further, when the aperture ratio of the device port 156 is 100[%] and the aperture ratio of the radiator port 152 is 0[%], the coolant circulates to the device 130. However, even in this case, since the circulation to the radiator 120 is stopped, the amount of coolant that can be circulated is limited. Therefore, when the engine rotational speed NE further increases, the pressures in the pipe such as the pump outlet passage 105, the water jacket outlet passage 101, the device inlet pipe 106, and the device outlet pipe 107 rises, and there is a risk of application of a large load to the passages 101 and 105 and the pipes 106 and 107.

Therefore, in the engine cooling system, the controller 160 sets the lower limit valve phase Lgrd, and sets the target valve phase to be larger than the request valve phase when the engine rotational speed NE is high, thereby executing the pressure relaxation control of increasing the aperture ratio of the radiator port 152.

Figure 3:
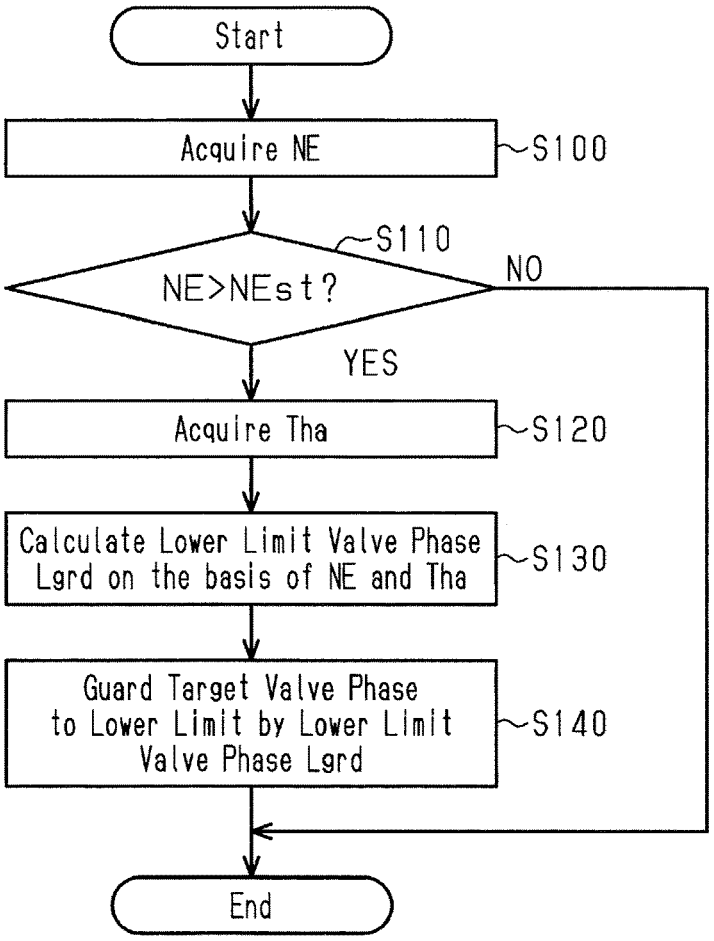
FIG. 3 is a flowchart illustrating the flow of a series of processes relating to pressure relaxation control.

Hereinafter, the pressure relaxation control will be described in detail. FIG. 3 is a flowchart illustrating the flow of a series of processes relating to the pressure relaxation control. The series of processes illustrated in FIG. 3 are repeatedly executed by the controller 160 at a predetermined control cycle when the request valve phase is equal to or less than a5[° ]. When the request valve phase is equal to or less than a5[° ], the aperture ratio of the radiator port 152 becomes a reference aperture ratio p1[%] lower than 100[%] as illustrated in FIG. 2.

As illustrated in FIG. 3, when starting the series of processes, first, the controller 160 acquires the engine rotational speed NE in step S100. Further, in step S110, it is determined whether or not the acquired engine rotational speed NE is higher than a reference rotational speed NEst. The reference rotational speed NEst is a value of magnitude at which it is possible to determine that no excessive load is applied to the pipe constituting the coolant circulation path 100 by the circulation of the cooling water through the relief passage 108 if the engine rotational speed NE is equal to or less than the reference rotational speed NEst.

When it is determined that the engine rotational speed NE is equal to or less than the reference rotational speed NEst in step S110 (step S110: NO), the controller 160 temporarily suspends the series of processes as it is, without doing anything.

When it is determined that the engine rotational speed NE is higher than the reference rotational speed NEst in step S110 (step S110: YES), the controller 160 advances the process to step S120. The controller 160 acquires the outdoor air temperature Tha in order to estimate the temperature of the radiator 120 in step S120. In step S130, the controller 160 calculates the lower limit valve phase Lgrd on the basis of the acquired engine rotational speed NE and the acquired outdoor air temperature Tha. The lower limit valve phase Lgrd is calculated such that the higher the engine rotational speed NE, the larger the lower limit valve phase Lgrd becomes. Further, the controller 160 regards the acquired outdoor air temperature Tha as the temperature of the radiator, and calculates the lower limit valve phase Lgrd such that the lower the temperature of the radiator, that is, the lower the outside air temperature Tha, the larger the lower limit valve phase Lgrd becomes.

Figure 4:
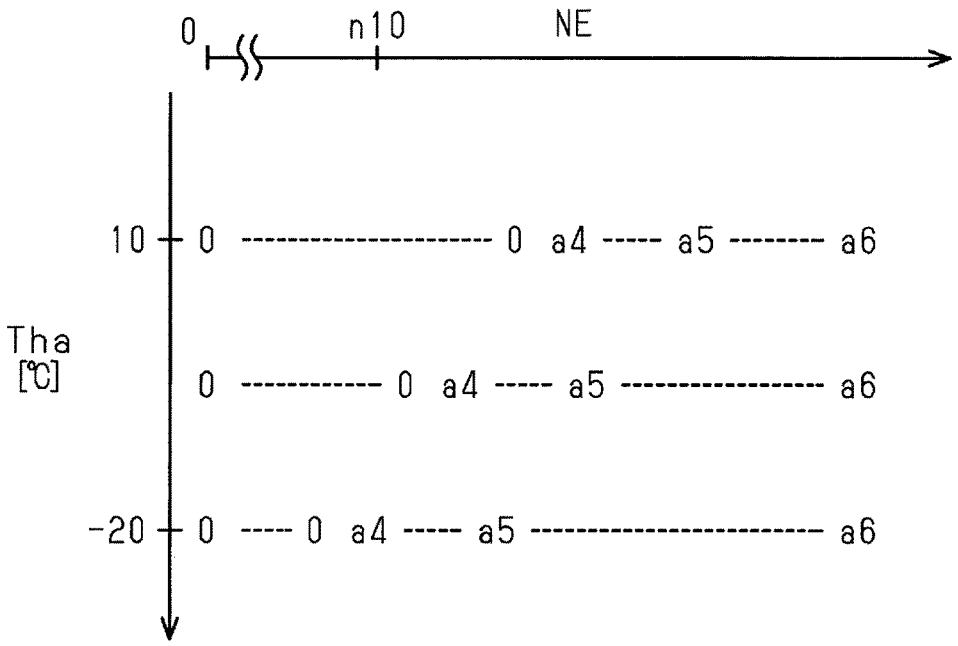
FIG. 4 is a diagram illustrating the engine rotational speed in relation to the outdoor air temperature and the lower limit valve phase.

Specifically, as illustrated in FIG. 4, the controller 160 receives the engine rotational speed NE and the outdoor air temperature Tha and calculates the lower limit valve phase Lgrd by referring to a map that outputs the lower limit valve phase Lgrd. In this map, the lower limit valve phase Lgrd is 0[° ] when the engine rotational speed NE is low. However, the lower limit valve phase Lgrd becomes a4[° ] when the engine rotational speed NE rises to some extent. As the engine rotational speed NE rises from the range, the lower limit valve phase Lgrd increases and finally becomes a6[° ]. Further, the lower the outdoor air temperature Tha, the lower become the engine rotational speed NE at which the lower limit valve phase Lgrd becomes a4[° ] and the engine rotational speed NE at which the lower limit valve phase Lgrd becomes a5[° ].

When the lower limit valve phase Lgrd is calculated in step S130, the controller 160 advances the process to step S140, and guards the target valve phase to the lower limit by the lower limit valve phase Lgrd in step S140. Specifically, the controller 160 sets the target valve phase to a larger one of the request valve phase and the lower limit valve phase Lgrd. Accordingly, when the request valve phase is less than the lower limit valve phase Lgrd, the target valve phase is changed to the lower limit valve phase Lgrd that is larger than the request valve phase. When the request valve phase is equal to or larger than the lower limit valve phase Lgrd, the target valve phase has a value equal to the value of the request valve phase. When the process of step S140 is executed in this way, the controller 160 temporarily suspends the series of processes. The processes in step S130 and step S140 in the series of processes correspond to the pressure relaxation control.

Figure 5:
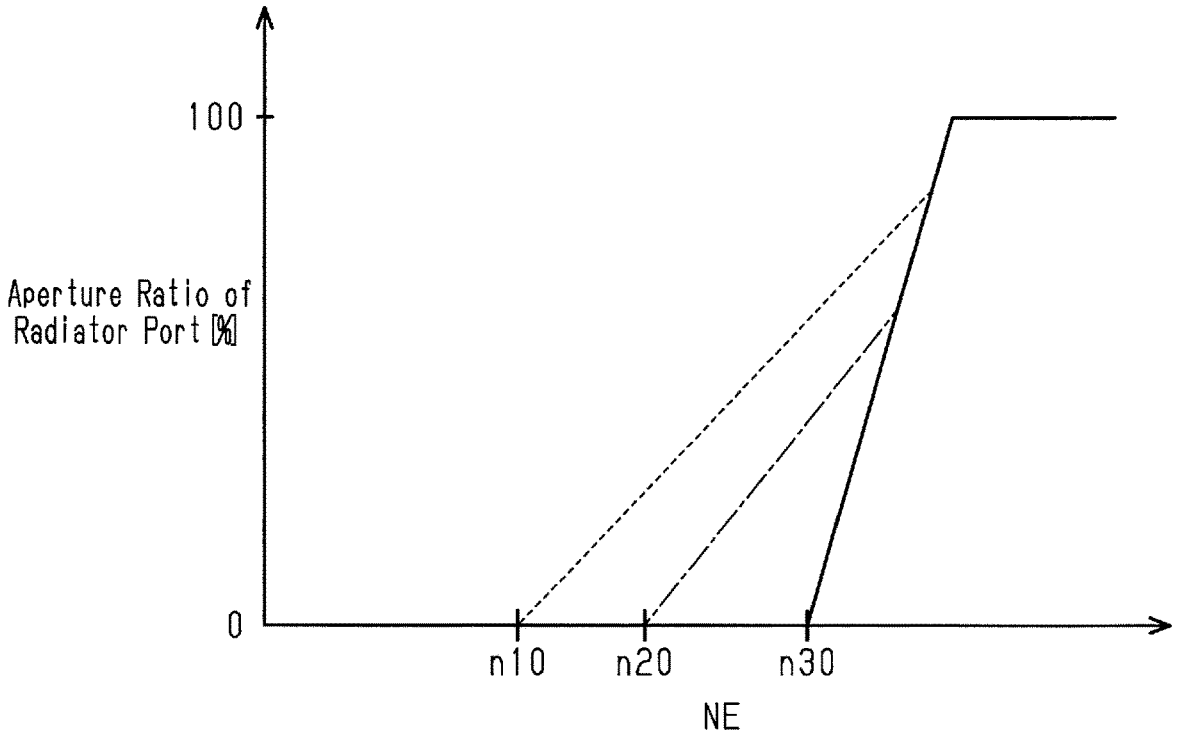
FIG. 5 is a graph illustrating a relationship between the engine rotational speed and the aperture ratio of the radiator port.

Next, the operation of the pressure relaxation control according to the present embodiment will be described with reference to FIGS. 5 to 7. FIG. 5 is a graph illustrating the relationship between the engine rotational speed NE and the aperture ratio of the radiator port 152 when the outlet fluid temperature Thwout is a temperature lower than the warming-up completion temperature, for example, 50[° C.] and the request valve phase is a3[° ]. In FIG. 5, the relationship between the engine rotational speed NE and the aperture ratio of the radiator port 152 when the outdoor air temperature Tha is 20° C. or higher is illustrated by a solid line. Also, the relationship between the engine rotational speed NE and the aperture ratio of the radiator port 152 when the outdoor air temperature Tha is −10[° C.] is indicated by a long dashed short dashed line. The relationship between the engine rotational speed NE and the aperture ratio of the radiator port 152 when the outdoor air temperature Tha is −20[° C.] is indicated by a broken line.

As described above with reference to FIG. 4, in the pressure relaxation control, the controller 160 calculates the lower limit valve phase Lgrd on the basis of the outdoor air temperature Tha and the engine rotational speed NE such that the lower the outdoor air temperature Tha, the lower become the engine rotational speed NE at which the lower limit valve phase Lgrd becomes a4[° ] and the engine rotational speed NE at which the lower limit valve phase Lgrd becomes a5[° ].

Therefore, as illustrated in FIG. 5, when the engine rotational speed NE rises, the lower limit valve phase Lgrd calculated through the pressure relaxation control exceeds the request valve phase a3[° ], the target valve phase is guarded to the lower limit by the lower limit valve phase Lgrd, and the aperture ratio of the radiator port 152 increases.

At this time, as indicated by the solid line in FIG. 5, when the outdoor air temperature Tha is 20[° C.] or higher, the radiator port 152 starts to open when the engine rotational speed NE is n30. As the engine rotational speed NE rises, the aperture ratio of the radiator port 152 increases, and the radiator port 152 is fully opened.

In contrast, as indicated by the long dashed short dashed line in FIG. 5, when the outdoor air temperature Tha is −10[° C.], the radiator port 152 starts to open when the engine rotational speed NE is n20, which is lower than n30, and as the engine rotational speed NE rises, the aperture ratio of the radiator port 152 increases. Further, from the middle, the aperture ratio of the radiator port 152 changes in accordance with the engine rotational speed NE in the same manner as a case where the outdoor air temperature Tha is 20[° C.], and the radiator port 152 is fully opened.

As illustrated by the broken line in FIG. 5, when the outdoor air temperature Tha is −20[° C.], the radiator port 152 starts to open when the engine rotational speed NE is n10, which is lower than n20, and as the engine rotational speed NE rises, the aperture ratio of the radiator port 152 increases. Further, from the middle, the aperture ratio of the radiator port 152 changes in accordance with the engine rotational speed NE in the same manner as a case where the outdoor air temperature Tha is 20[° C.], so that the radiator port 152 is fully opened.

In this way, even if the warming-up of the internal combustion engine is not completed, when the engine rotational speed NE is equal to or higher than the predetermined engine rotational speed, the controller 160 of the engine cooling system increases the aperture ratio of the radiator port 152 through the pressure relaxation control, as compared to a case where the engine rotational speed NE is less than the predetermined engine rotational speed. By increasing the aperture ratio of the radiator port 152 in this way, the stop of the circulation of the coolant to the radiator 120 by the warming-up promotion control is canceled. As a result, the coolant is also circulated through the control valve 150 to the radiator 120, and the large load is prevented from acting on the pipe constituting the coolant circulation path 100.

Further, as illustrated in FIG. 5, in the engine cooling system, when the outdoor air temperature Tha is low, the lower the temperature of the radiator 120, the lower the engine rotation speed at which the aperture ratio of the radiator port 152 is increased becomes in the pressure relaxation control. In the pressure relaxation control as described above, the effect of increasing the aperture ratio of the radiator port 152 at a lower engine rotational speed as the temperature of the radiator 120 is lowered will be described with reference to FIGS. 6 and 7. FIGS. 6 and 7 are timing charts illustrating the relationship between changes in the engine rotational speed NE and the radiator flow rate and changes in the thermal distortion of the radiator when the temperature of radiator 120 is −20[° C.]. FIG. 7 is a timing chart illustrating the relationship between changes in the engine rotational speed NE and the radiator flow rate and changes in thermal distortion of the radiator in the engine cooling system of this embodiment.

Figure 6:
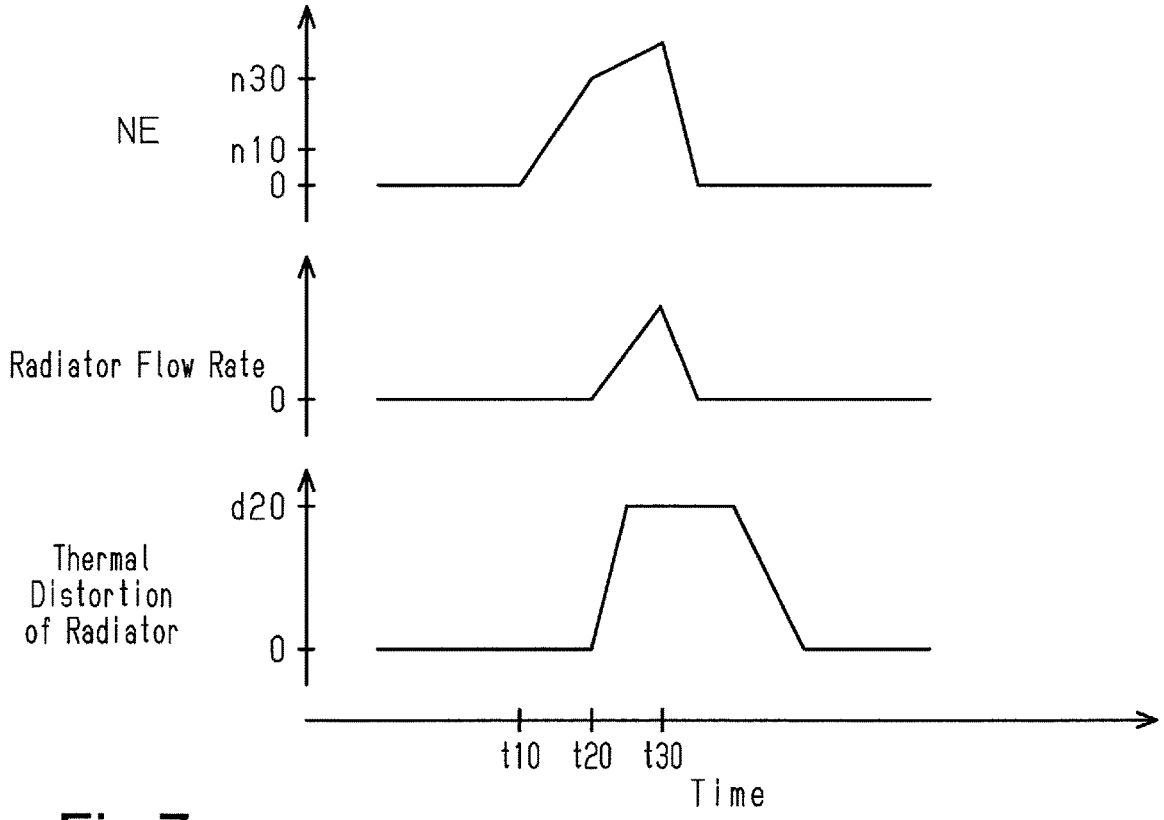
Fig.6(Prior Art)
FIG. 6 is a timing chart illustrating a relationship between changes in the engine rotational speed and the radiator flow rate and changes in the thermal distortion of the radiator in a conventional engine cooling system.

FIG. 6 is a comparative example, and is a timing chart illustrating the relationship between changes in the engine rotational speed NE and the radiator flow rate and changes in thermal distortion of the radiator in the conventional engine cooling system in which the radiator port 152 is opened whenever the engine rotational speed NE is equal to or higher than n30 irrespective of the temperature of the radiator 120 in the pressure relaxation control. In the case of this comparative example, the pressure relaxation control is always executed in the manner illustrated by the solid line in FIG. 5 irrespective of the temperature of the radiator 120. Even in the case of the comparative example illustrated in FIG. 6 and in the case of the engine cooling system of the embodiment illustrated in FIG. 7, the manner of change of the engine rotational speed NE is the same.

As illustrated in FIG. 6, in the case of the comparative example, when the engine rotational speed NE starts to increase at a point in time t10 and the engine rotational speed exceeds n30 at a point in time t20, the aperture ratio of the radiator port 152 increases through the pressure relaxation control, and the coolant circulates through the radiator 120. As a result, after the point in time t20, the radiator flow rate, which is the amount of the coolant passing through the radiator 120 per unit time, gradually increases.

At this time, since the temperature of the radiator 120 is −20[° C.], the radiator port 152 is opened at the point in time t20. When the coolant warmed through the water jacket 110 flows into the radiator 120, the radiator 120 is warmed and thermal distortion occurs.

Further, when the engine rotational speed NE starts to decrease at a point in time t30, the aperture ratio of the radiator port 152 decreases with the decrease in the engine rotational speed NE, the discharge amount of the coolant from the pump 140 decreases, and the radiator flow rate decreases. Further, the radiator flow rate becomes 0, and the thermal distortion of the radiator 120 is canceled.

Figure 7:
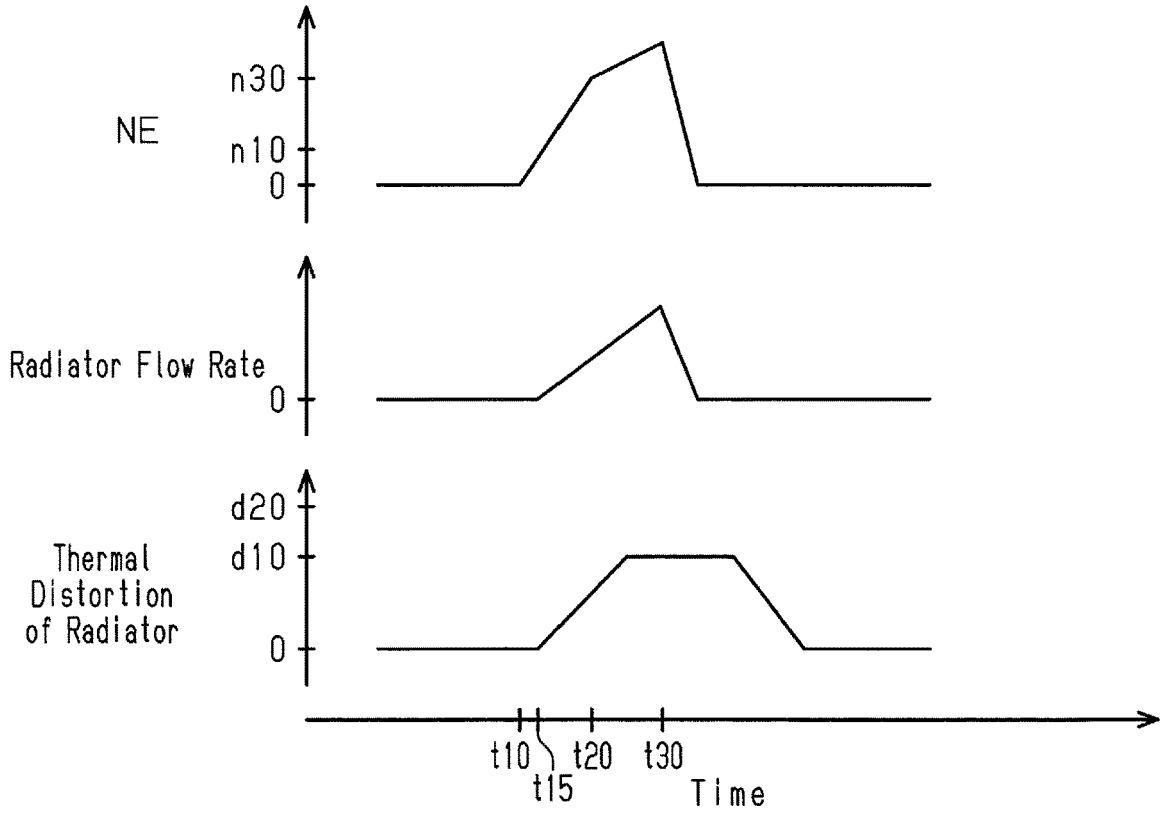
FIG. 7 is a timing chart illustrating a relationship between changes in the engine rotational speed and the radiator flow rate and changes in the thermal distortion of the radiator in the engine cooling system according to the embodiment.

In contrast, as illustrated in FIG. 7, in the case of the engine cooling system of this embodiment, the aperture ratio of the radiator port 152 increases through the pressure relaxation control after the engine rotational speed NE starts to increase at the point in time t10 from the time when the engine rotational speed exceeds n10 at a point in time t15 before the point in time t20. As a result, the coolant is circulated to the radiator 120 from the point in time t15, and the radiator flow rate, which is the amount of the coolant that passes through the radiator 120 per unit time gradually, increases from the point in time t15. In this way, in the case of the engine cooling system, the engine rotational speed NE is lower than the case of the comparative example illustrated in FIG. 6, and the stop of the circulation of the coolant to the radiator 120 from the time when the discharge amount of the coolant from the pump 140 is small is canceled. Therefore, the increase in the radiator flow rate is gentle as compared with the case of the comparative example in which the stop of circulation is canceled in a state in which the discharge amount from the pump 140 is large. Therefore, the radiator port 152 is opened at the point in time t15, the temperature change of the radiator 120 when the coolant warmed by passing through the water jacket 110 flows into the radiator 120 is relaxed as compared with the case of the comparative example, and the thermal distortion is also suppressed.

Specifically, as illustrated in FIG. 6, the maximum value of thermal distortion in the comparative example, in which the radiator port 152 starts to open at the time when the engine rotational speed NE becomes n30, is d20. In contrast, as illustrated in FIG. 7, the maximum value of thermal distortion in the engine cooling system, in which the radiator port 152 starts to open when the engine rotational speed NE becomes n10, is d10, which is smaller than d20.

Even in the case of the engine cooling system, when the engine rotational speed NE starts to decrease at a point in time t30, the aperture ratio of the radiator port 152 decreases with the decrease in the engine rotational speed NE, and the discharge amount of the coolant from the pump 140 also decreases and the radiator flow rate decreases. Further, the radiator flow rate becomes 0, and the thermal distortion of the radiator 120 is canceled.

The above-described embodiment achieves the following advantages.

(1) When the temperature of the radiator 120 is low, the aperture ratio of the radiator port 152 increases at a lower engine rotational speed, and the stop of circulation by the warming-up promotion control is canceled. That is, when the temperature of the radiator 120 is low, the stop of the circulation of the coolant to the radiator 120 is canceled in a state in which the discharge amount from the pump 140 is small. This makes it possible to alleviate the temperature change of the radiator 120 when the stop of the circulation of the coolant to the radiator 120 is canceled as compared with a case where the stop of the circulation is canceled in a state in which the discharge amount from the pump 140 is large, and the thermal distortion of the radiator 120 by the cancellation of the stop of the circulation can be suppressed.

Therefore, it is possible to suppress the effect of a large load on components such as the pipe constituting the coolant circulation path 100, while suppressing the thermal distortion of the radiator 120 caused by the cancellation of the stop of the circulation of the coolant to the radiator 120.

(2) In order to promote warming-up, it is preferable to stop the circulation of the coolant to the radiator 120 as much as possible until the warming-up is completed. In this regard, in the case of this engine cooling system, when the temperature of the radiator 120 is low and large thermal distortion is more likely to occur with the cancellation of the stop of circulation of the coolant to the radiator 120, the aperture ratio of the radiator port 152 is increased in the state in which the discharge amount from the pump 140 is small, and the stop of the circulation of the coolant to the radiator 120 is canceled. That is, the engine rotational speed for cancelling the stop of circulation changes in accordance with the magnitude of the risk of occurrence of thermal distortion. Therefore, it is possible to promote warming-up and protection of the engine cooling system at the same time.

(3) If the period during which the operation of the internal combustion engine is stopped until the start of the internal combustion engine is sufficiently long, the temperature of the radiator 120 is equal to the outdoor air temperature Tha. Therefore, in the pressure relaxation control executed between the start of the internal combustion engine and the completion of the warming-up, the temperature of the radiator 120 can be estimated, using the outdoor air temperature. In the engine cooling system, the controller 160 executes the pressure relaxation control by regarding the outdoor air temperature Tha as the temperature of the radiator 120. Therefore, it is possible to execute the pressure relaxation control, without separately providing a sensor for measuring the temperature of the radiator 120.

(4) As illustrated in FIG. 5, in the engine cooling system, in the pressure relaxation control, when the engine rotational speed NE is high and the amount of coolant discharged from the pump 140 per unit time is increased, that is, as the pressure in the coolant circulation path 100 is more likely to rise, the aperture ratio of the radiator port 152 is changed by a greater amount. As a result, the aperture ratio of the radiator port 152 can be increased in accordance with the magnitude of the risk that the pressure in the coolant circulation path 100 may rise. Therefore, it is possible to further promote warming-up and protection of the engine cooling system.

(5) In the engine cooling system, when the request valve phase is a5[° ] or less, that is, when the aperture ratio of the radiator port 152 is equal to or less than the reference aperture ratio p1[%], a series of processes described with reference to FIG. 3 is executed. That is, when the aperture ratio of the radiator port 152 is larger than the reference aperture ratio p1[%], the controller 160 does not execute the pressure relaxation control. In short, in the engine cooling system, the controller 160 executes the pressure relaxation control on condition that the aperture ratio of the radiator port 152 is equal to or less than the reference aperture ratio p1.

In the first place, when the aperture ratio of the radiator port 152 is sufficiently large, there is a case where it is not necessary to execute the pressure relaxation control to increase the aperture ratio of the radiator port 152. In this regard, in the engine cooling system, since the pressure relaxation control is executed on condition that the aperture ratio of the radiator port 152 is equal to or less than the reference aperture ratio p1, it is possible to suppress the execution of the pressure relaxation control in a case where the aperture ratio of the radiator port 152 increases and the restriction of circulation of the coolant to the radiator 120 does not need to be executed. Therefore, it is possible to suppress the wasteful execution of the series of processes illustrated in FIG. 3 and to suppress the calculation load of the controller 160.

(6) In the series of processes described with reference to FIG. 3, the controller 160 executes the pressure relaxation control on condition that the engine rotational speed NE is equal to or higher than the reference rotational speed NEst. When the engine rotational speed NE is low, since the discharge amount of the coolant from the pump 140 per unit time is small, in some cases, it is not necessary to execute the pressure relaxation control to increase the aperture ratio of the radiator port 152. In this regard, according to the engine cooling system, since the pressure relaxation control is executed on condition that the engine rotational speed NE is equal to or higher than the reference rotational speed NEst, when it is not necessary to increase the aperture ratio of the radiator port 152 to alleviate the restriction of the circulation of the coolant to the radiator 120, it is possible to suppress the execution of the pressure relaxation control. Therefore, unnecessary calculation of the lower limit valve phase Lgrd can be suppressed, and the calculation load of the controller 160 can be suppressed.

The above-described embodiment may be modified as follows.

The mode of controlling the valve phase when pressure suppression control is not being executed is not limited to the above example. For example, the length of the period during which the request valve phase is kept at 0[° ] in the warming-up promotion control after the start of the engine may be always a constant length, irrespective of the outlet liquid temperature Thwout at the time of starting the engine. Further, the device port 156 may be opened, when the outlet liquid temperature Thwout becomes equal to or higher than the predetermined temperature lower than the warming-up completion temperature after the start of the engine. The target liquid temperature when controlling the valve phase after completion of warming-up may be variably set in accordance with the operating state of the internal combustion engine, or may be set at a constant temperature, irrespective of the operating state of the internal combustion engine.

In the embodiment, a system including the relief passage 108 for connecting the pump outlet passage 105 and the device outlet pipe 107 is illustrated. The mode of connection of the relief passage is not limited to this mode. That is, the relief passage may be connected so that excessive rise of pressure can be suppressed when both the aperture ratio of the device port 156 and the aperture ratio of the radiator port 152 in the control valve 150 are 0[%]. For example, a relief passage which connects the water jacket outlet passage 101 and the device outlet pipe 107 may be provided.

An embodiment is illustrated in which the control valve 150 includes a device port 156 and a radiator port 152, in addition to the inlet port 151. Even in a case where the control valve 150 is provided with another port, it is possible to apply a configuration for executing the pressure relaxation control in the same manner as in the above embodiment. In other words, the coolant circulation path 100 may include a path for circulating the coolant, in addition to a path for circulating the coolant through the device 130 and a path for circulating the coolant through the radiator 120. Further, as long as the coolant circulation path 100 includes a path for circulating the coolant through the radiator 120, it is possible to employ a configuration which executes the pressure relaxation control in the same manner as in the above embodiment. Accordingly, the coolant circulation path 100 does not necessarily need to have a path for circulating the coolant through the device 130.

The configuration of the control valve 150 is not limited to a rotary type valve, in which the aperture ratio of each of the ports 152 and 156 varies as the valve body 158 rotates in the housing 155. For example, as a control valve, a spool valve may be employed, which changes the aperture ratio of each of the ports 152 and 156 by axially moving, inside the housing, a rod-shaped spool housed in the housing.

The conditions under which the pressure relaxation control is executed may be appropriately changed. For example, in the above embodiment, a series of processes illustrated in FIG. 3 is executed when the request valve phase is a5[° ] or less, and the pressure relaxation control is executed on condition that the aperture ratio of the radiator port 152 is equal to or less than the reference aperture ratio p1. However, this condition may be omitted. That is, the series of processes illustrated in FIG. 3 may be executed repeatedly during the operation of the engine. In the above-described embodiment, the pressure relaxation control is executed on condition that the engine rotational speed NE is equal to or higher than the reference rotational speed NEst. However, this condition may be omitted. That is, when the series of processes illustrated in FIG. 3 is executed irrespective of the engine rotational speed NE, the pressure relaxation control may be executed. Further, the pressure relaxation control may be executed only during the warming-up promotion control. Even if the same pressure relaxation control as that in the above embodiment is executed, the request valve phase directly becomes the target valve phase when the request valve phase is equal to or higher than the lower limit valve phase Lgrd. Therefore, the aperture ratio of the radiator port 152 is not increased by the pressure relaxation control.

An example in which the controller 160 regards the outdoor air temperature Tha as the temperature of the radiator and executes the pressure relaxation control has been illustrated. However, the temperature of the radiator 120 may be acquired by another method. For example, a temperature sensor for detecting the temperature may be provided in the radiator 120, and the temperature of the radiator 120 may be detected by the temperature sensor. Further, a liquid temperature sensor for detecting the temperature of the coolant in the radiator 120 may be provided, and the temperature of the coolant in the radiator 120 may be regarded as the temperature of the radiator 120.

As indicated by the broken line and the long dashed short dashed line in FIG. 5, the pressure relaxation control is illustrated in which the higher the engine rotational speed NE, the higher the aperture ratio of the radiator port 152 is made. The pressure relaxation control may be performed such that, when the temperature of the radiator 120 is low, the aperture ratio of the radiator port 152 is increased at a lower engine rotational speed than a case where the temperature of the radiator 120 is high.

Figure 8:
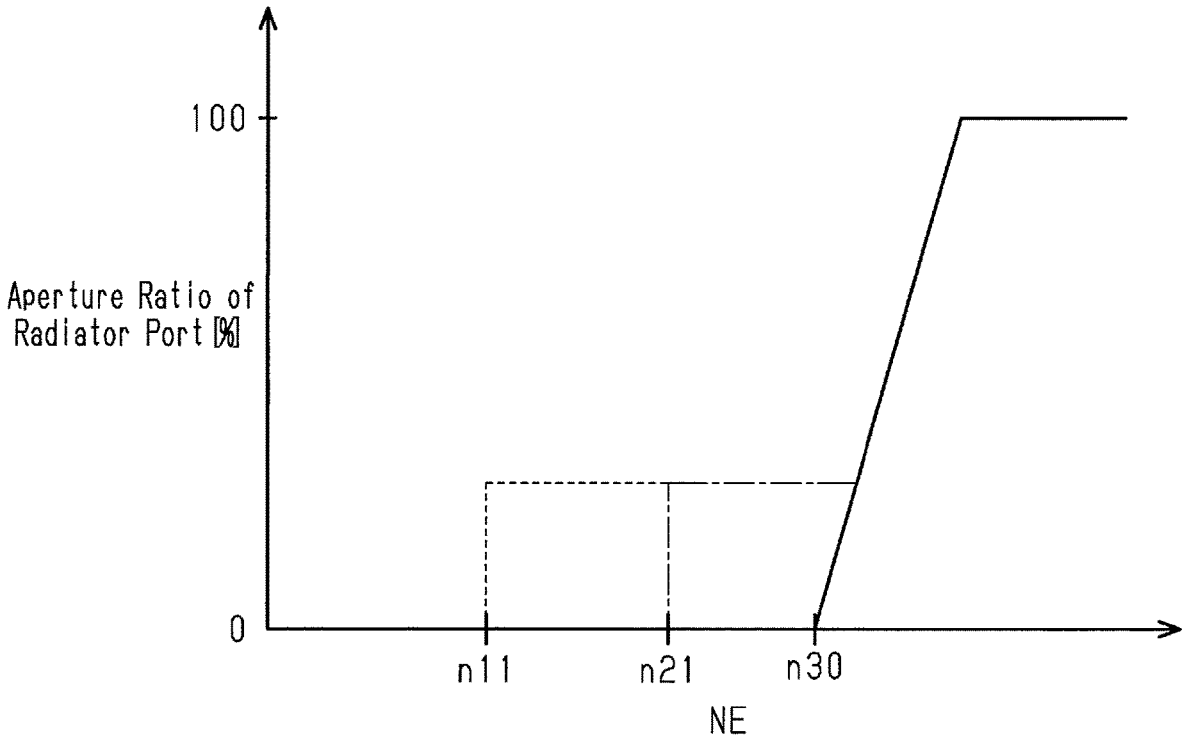
FIG. 8 is a graph illustrating a relationship between the engine rotational speed and the aperture ratio of the radiator port in an engine cooling system of a modification.

For example, as illustrated in FIG. 8, a configuration may be employed in which the aperture ratio of the radiator port 152 is increased to a constant aperture ratio regardless of the engine rotational speed NE, and it may be configured such that the lower the temperature of the radiator 120, the lower becomes the engine rotational speed at which the aperture ratio of the radiator port 152 is increased to a certain aperture ratio.

In the example illustrated in FIG. 8, as indicated by long dashed short dashed line, when the temperature of the radiator 120 is −10[° C.], if the engine rotational speed NE becomes equal to or higher than n21, which is lower than n30, the radiator port 152 is opened, and the aperture ratio of the radiator port 152 becomes a constant magnitude. Further, from the middle, the aperture ratio of the radiator port 152 starts changing in accordance with the engine rotational speed NE in the same manner as a case where the outdoor air temperature Tha is 20[° C.], and the radiator port 152 is fully opened.

Also, as illustrated by the broken line, when the outdoor air temperature Tha is −20[° C.], if the engine rotational speed NE becomes equal to or higher than n11, which is lower than n21, the radiator port 152 is opened, and the aperture ratio of the radiator port 152 becomes a certain magnitude. Further, from the middle, the aperture ratio of the radiator port 152 changes in accordance with the engine rotational speed NE in the same manner as a case where the outdoor air temperature Tha is 20[° C.], and the radiator port 152 is fully opened.

Even in a case where the pressure relaxation control for increasing the aperture ratio of the radiator port 152 is executed in this manner, when the temperature of the radiator 120 is low, the stop of circulation of the coolant to the radiator 120 is canceled in a state in which the discharge amount from the pump 140 is small. This makes it possible to alleviate the temperature change of the radiator 120 when the stop of the circulation of the coolant to the radiator 120 is canceled as compared with a case where the stop of the circulation is canceled in a state in which the discharge amount from the pump 140 is large, and the thermal distortion of the radiator 120 due to the cancellation of the stop of circulation can be suppressed. Therefore, as in the above-described embodiment, it is possible to suppress the effect of a large load on the components such as a pipe constituting the coolant circulation path 100, while suppressing the thermal distortion of the radiator 120 caused by the cancellation of the stop of the circulation of the coolant to the radiator 120.

In the above embodiment, the lower limit valve phase Lgrd at each engine rotational speed NE is set in accordance with the temperature of the radiator 120, and the aperture ratio of the radiator port 152 is set to be large from the low engine rotational speed as the temperature of the radiator 120 is lower. In this regard, the pressure relaxation control may be performed such that, when the temperature of the radiator 120 is low, the aperture ratio of the radiator port 152 is set to be large at a lower engine rotational speed, as compared to a case where the temperature of the radiator 120 is high.

For example, a threshold value of the temperature for switching the engine rotational speed NE for increasing the aperture ratio of the radiator port 152 is provided, and when the temperature of the radiator 120 is less than the threshold value, the aperture ratio of the radiator port 152 may be set to be large at the low engine rotational speed, as compared to a case where the temperature of the radiator 120 is equal to or higher than the threshold value. Even in this case, as compared with a case where the stop of the circulation is canceled in a state in which the discharge amount from the pump 140 is large when the temperature of the radiator 120 is low, it is possible to alleviate the temperature change of the radiator 120 when the stop of the circulation of the coolant to the radiator 120 is canceled, and it is possible to suppress the thermal distortion of the radiator 120 caused by cancellation of the stop of circulation.

The pressure relaxation control of increasing the aperture ratio of the radiator port 152 by guarding the target valve phase to the lower limit by the lower limit valve phase Lgrd was described as an example. A specific method for increasing the aperture ratio of the radiator port 152 by the pressure relaxation control can be appropriately changed. For example, rather than calculating the lower limit valve phase Lgrd, the target valve phase which is larger than a case where the pressure relaxation control is not executed from the temperature of the radiator 120 and the engine rotational speed NE may be directly calculated, and the aperture ratio of the radiator port 152 may be increased.

The controller 160 is not limited to a device that includes a central processing unit and a memory and executes all the above-described processes through software. For example, the controller 160 may include dedicated hardware (an application specific integrated circuit: ASIC) that executes at least part of the various processes. That is, the controller 160 may be circuitry including 1) one or more dedicated hardware circuits such as an ASIC, 2) one or more processors (microcomputers) that operate according to a computer program (software), or 3) a combination thereof.

The invention claimed is:

1. An engine cooling system comprising: a coolant circulation path, which circulates coolant between a water jacket and a radiator of an internal combustion engine; a pump, which is provided in the coolant circulation path and operates in conjunction with rotation of an output shaft of the internal combustion engine; a control valve, which is provided in the coolant circulation path and has a housing having a radiator port connected to the radiator and a valve body accommodated in the housing, the control valve being configured such that an aperture ratio of the radiator port changes in a range from 0% to 100% by movement of the valve body inside the housing; and a controller configured to control the control valve, wherein the controller is configured to execute a warming-up promotion control for setting the aperture ratio of the radiator port to 0% when warming-up of the internal combustion engine is not completed, and a pressure relaxation control executed during the warming-up promotion control, the pressure relaxing control reducing pressure in the coolant circulation path by increasing the aperture ratio of the radiator port when the engine rotational speed is equal to or higher than a predetermined engine rotational speed even if warming-up of the internal combustion engine is not completed, as compared with a case where the engine rotational speed is less than the predetermined engine rotational speed, and the controller is configured to control the aperture ratio of the radiator port in the pressure relaxation control such that as the temperature of the radiator decreases, engine rotational speed at which the aperture ratio of the radiator port is increased also decreases.

2. The engine cooling system according to claim 1, wherein the controller is configured to execute the pressure relaxation control by estimating the temperature of the radiator using an outdoor air temperature.

3. The engine cooling system according to claim 1, wherein the controller is configured to control the control valve in accordance with the engine rotational speed such that the higher the engine rotational speed, the higher the aperture ratio of the radiator port becomes, when the aperture ratio of the radiator port is increased in the pressure relaxation control.

4. The engine cooling system according to claim 1, wherein the controller is configured to execute the pressure relaxation control on a condition that the aperture ratio of the radiator port is equal to or less than a reference aperture ratio lower than 100%.

5. The engine cooling system according to claim 1, wherein the controller is configured to execute the pressure relaxation control on a condition that the engine rotational speed is equal to or higher than a reference rotational speed.

6. The engine cooling system according to claim 1, wherein the pressure relaxation control is only executed during the warming-up promotion control.

7. An engine cooling system comprising:

a coolant circulation path, which circulates coolant between a water jacket and a radiator of an internal combustion engine;

a pump, which is provided in the coolant circulation path and operates in conjunction with rotation of an output shaft of the internal combustion engine;

a control valve, which is provided in the coolant circulation path and has a housing having a radiator port connected to the radiator and a valve body accommodated in the housing, the control valve being configured such that an aperture ratio of the radiator port changes in a range from 0% to 100% by movement of the valve body inside the housing; and a controller configured to control the control valve, wherein the controller is configured to execute a warming-up promotion control for setting the aperture ratio of the radiator port to 0% when warming-up of the internal combustion engine is not completed, and a pressure relaxation control executed during the warming-up promotion control, the pressure relaxing control reducing pressure in the coolant circulation path by increasing the aperture ratio of the radiator port when the engine rotational speed is equal to or higher than a predetermined engine rotational speed even if warming-up of the internal combustion engine is not completed, as compared with a case where the engine rotational speed is less than the predetermined engine rotational speed, and the controller is configured to control the aperture ratio of the radiator port in the pressure relaxation control such that when the temperature of the radiator is lower than a threshold value as compared with a case in which the temperature of the radiator is equal to or higher than the threshold value, the engine rotational speed at which the aperture ratio of the radiator port is increased becomes lower.

8. The engine cooling system according to claim 7, wherein the pressure relaxation control is only executed during the warming-up promotion control.

* * * * *